US006250845B1

(12) United States Patent
Deaton et al.

(10) Patent No.: US 6,250,845 B1
(45) Date of Patent: Jun. 26, 2001

(54) EROSION CONTROL APPARATUS

(76) Inventors: Gary Deaton, 180 Peachtree La.; Brian T. Baumgartner, ON268 Calvin; Frank Baker, 523 E. Elmwood Ave., all of West Chicago, IL (US) 61085

( * ) Notice: Subject to any disclaimer, the term of this patent is extended or adjusted under 35 U.S.C. 154(b) by 0 days.

(21) Appl. No.: 09/326,408

(22) Filed: Jun. 4, 1999

(51) Int. Cl.[7] ..... E02B 3/06

(52) U.S. Cl. ..... 405/33; 404/35; 404/40; 404/41; 404/42; 405/16; 405/30; 405/35; 405/272

(58) Field of Search ..... 405/15, 16, 17, 405/20, 21, 29, 30, 33, 35, 272, 273; 404/35, 37, 38, 40, 41, 42, 44

(56) References Cited

U.S. PATENT DOCUMENTS

| | | | | |
|---|---|---|---|---|
| 1,026,616 | * | 5/1912 | Stratton | 405/16 |
| 1,487,668 | * | 3/1924 | Rehfeld | 405/29 |
| 2,008,866 | * | 7/1935 | Hoffard | 405/20 |
| 2,191,924 | * | 2/1940 | Humphrey | 405/33 |
| 2,653,525 | * | 9/1953 | McGuire | 404/35 |
| 2,683,968 | * | 7/1954 | Budd | 405/33 |
| 4,360,153 | * | 11/1982 | Mantion et al. | 404/35 |
| 4,596,731 | * | 6/1986 | Cudmore et al. | 404/41 |
| 4,716,694 | * | 1/1988 | Freissle | 404/40 |
| 5,160,215 | * | 11/1992 | Jensen | 405/16 |
| 5,190,403 | | 3/1993 | Atkinson . | |

OTHER PUBLICATIONS

The Presto GEOWEB Cellular Confinement System Brochure, Presto Products Company 1992.

Armortec Concrete Erosion Control Systems, Securing the Environment Brochure, ARMORTEC No date.

Tri–lock Articulated Erosion Control System, American Excelsior Company, 1993 A–Jacks Stream Restoration Installation Manual, ARMORTEC.

* cited by examiner

*Primary Examiner*—Thomas B. Will
*Assistant Examiner*—Alexandra K. Pechhold
(74) *Attorney, Agent, or Firm*—Laff, Whitesel & Saret, Ltd.

(57) ABSTRACT

An apparatus for use in erosion control comprising a primary member and a secondary member pivotally connectable to the primary member to form a unit. The unit can be connected to another like unit to form a protective network of such units.

8 Claims, 11 Drawing Sheets

EROSION CONTROL APPARATUS

FIELD OF THE INVENTION

The invention relates to an apparatus for protecting stream banks, shorelines and other areas from erosion.

BACKGROUND OF THE INVENTION

In nature, wind and water can exert forces upon the earth's surface and carry away soil, rock and other materials. In addition, mankind's influence on the environment often exacerbates these natural erosion processes. For example, natural erosion can be accelerated by altering the course of a stream or removing foliage which would otherwise help anchor soil in place.

Soil erosion is a particular problem in areas such as riversides, stream banks, shorelines, beachfronts or other submersed areas. In these environments, the force created by flowing water current or crashing waves can, over time, carry away large amounts of earth and cause significant and costly damage to property. For example, erosion can destroy the integrity of the base of a stream bank, making it necessary to restabilize the area through an expensive process of filling and structural repair. Similarly, erosion, if not controlled, can cause valuable waterfront property to simply disappear.

Previous attempts to develop an effective, easy and efficient way of controlling erosion have not been successful. One such prior art attempt is the use of a solid wall to abut and protect the area in question. For example, a cement or log wall can be installed along the underwater base of a stream bank to prevent the stream from contacting, and thereby eroding, the bank. This approach, however, has numerous drawbacks. A solid wall is costly, difficult, and in some locations, impossible to install. Also, a wall is aesthetically not attractive.

A solid wall is also not environmentally attractive because it is not an effective method for controlling erosion. A solid wall does not dissipate the energy generated by the flow of water. Rather, water flowing along the wall will accelerate, thereby causing greater erosion to occur at those locations not protected by the wall, such as the stream or riverbed. Moreover, vegetation, which helps anchor soil and prevent further erosion from wind and rain, will not grow on a solid wall.

Some other prior art attempts to control erosion involve the use of interlocking units to help stabilize an area. In such systems, a trench is dug at the underwater base of the submersed area in question. One by one, the interlocking units are placed in a row within the trench to form a base for the protective cover. The remainder of the protective cover, or "revetment," is formed by stacking additional rows of units upon the base row until the units cover the area to be protected.

Prior art erosion control systems that feature interlocking units suffer from a variety of drawbacks. The units are large, heavy and cumbersome, making the transportation and installation of the units burdensome and expensive. Also, because the units are interlocking, they overlap one another so that a large number of units are required to cover the area being protected.

In addition, because the units are not positively connected to one another, but merely interlock with or rest against one another, one or more of the units can shift independently of the other units along any of the three dimensions. This undermines their effectiveness at erosion control and, in turn, destabilizes the area in question. Another drawback of these systems is that the density of the protective cover, i.e., the amount of space between each unit, is not easily adjustable—to adjust the density of the cover, one must go through the time-consuming and burdensome task of placing one or more spacing members on or between each individual unit.

OBJECTS OF THE INVENTION

An object of this invention is to provide an apparatus which effectively controls erosion.

Another object of the invention is to provide an erosion control apparatus which allows a cover of vegetation to grow at the protected site.

A further object of the invention is to provide an erosion control apparatus which is easy to transport and install.

An additional object of the invention is to provide an erosion control device which is stable along all three dimensions.

Another object of the invention is to provide an erosion control device which has a density that is easily adjustable.

BRIEF SUMMARY OF THE INVENTION

The present invention features a protective network formed by connecting together modular components. Each modular component comprises two cross members of equal or unequal length pivotally connected to form an X-shaped apparatus. One or more link sites are located along the length of each cross member which allow the cross member to be pivotally connected to a cross member of a similar modular component. In this manner, each modular component can be pivotally connected to similar modular components located above, below, and to the left and/or right of the modular component to form a protective network.

Due to the shape of the inventive modules, the protective network contains a multitude of gaps. Accordingly, a top layer of soil and vegetation can be placed within and over the protective network to help anchor the soil and protect it from erosion. Additionally, to increase stability, a filter fabric layer can be placed over the installed network prior to adding the top layer of soil. Moreover, because each of the modules is connected to, as opposed to merely interlocked with, its neighboring modules, the resulting protective network is stable in all three dimensions. In a preferred embodiment, stability and erosion protection are further increased by the use of a plurality of legs projecting from the cross members and into the soil to help anchor both the soil and the protective network. Anchors, such as duckbills or cables, may also be used throughout the network to increase stability.

The density of the resulting network is also easily adjustable. Because the cross members of each module are pivotally connected, the angle between the members, and therefore, the amount of space between them and between the neighboring modules, can be increased or decreased merely by opening or closing the X-shaped module like a pair of scissors. This pivotal connection feature also makes transporting the inventive modules easier and less expensive than prior art modules because the inventive modules can be collapsed to facilitate shipping.

The design of the inventive modules also facilitates installation. Like prior art modules, the inventive modules can be placed in a row within a trench to form an anchoring base for the protective network. Because of the increased stability of the inventive modules, however, the trench used for the inventive modules need not be as deep as a trench used for prior art modules. Therefore, when installing the inventive modules, there is less work involved in digging the base trench, less excavated matter to carry away, and less sedimentation of the adjoining stream bank or other submerged area. The installation of the inventive modules is also easier and less expensive because they are lighter and more manageable than the heavier, more wieldly prior art modules.

DETAILED DESCRIPTION OF THE PREFERRED EMBODIMENT

Figure 1:
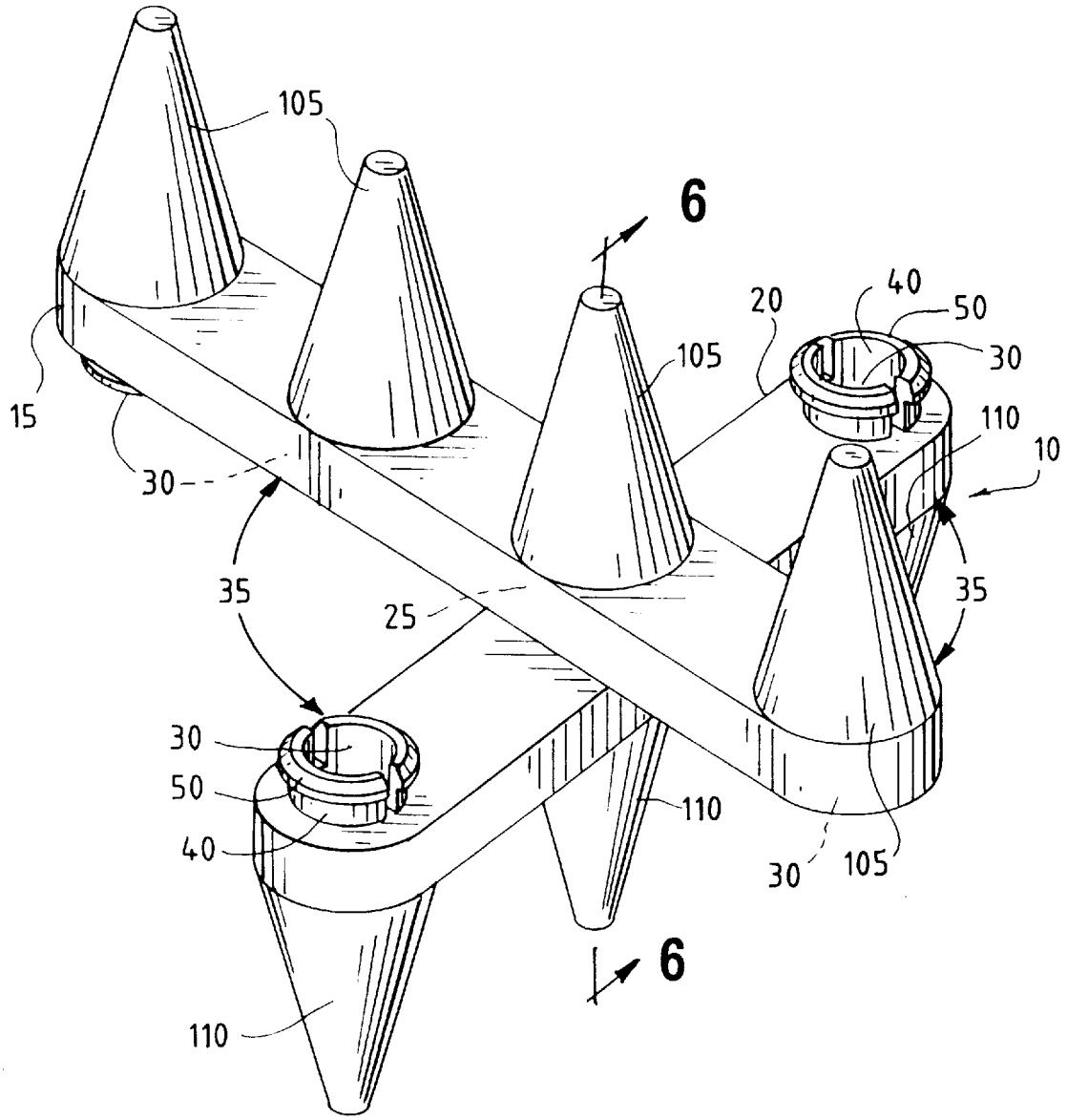
FIG. 1 is a perspective view of a preferred embodiment of the invention.

Referring to FIG. 1, module 10 comprises a primary member 15 and a secondary member 20. Primary member 15 and secondary member 20 can be any suitable size or shape and can be made from any suitable material. In the preferred embodiment, module is an X-shaped apparatus and each member measures 24"×3"×1.75" and is constructed from HDPE.

Figure 2:
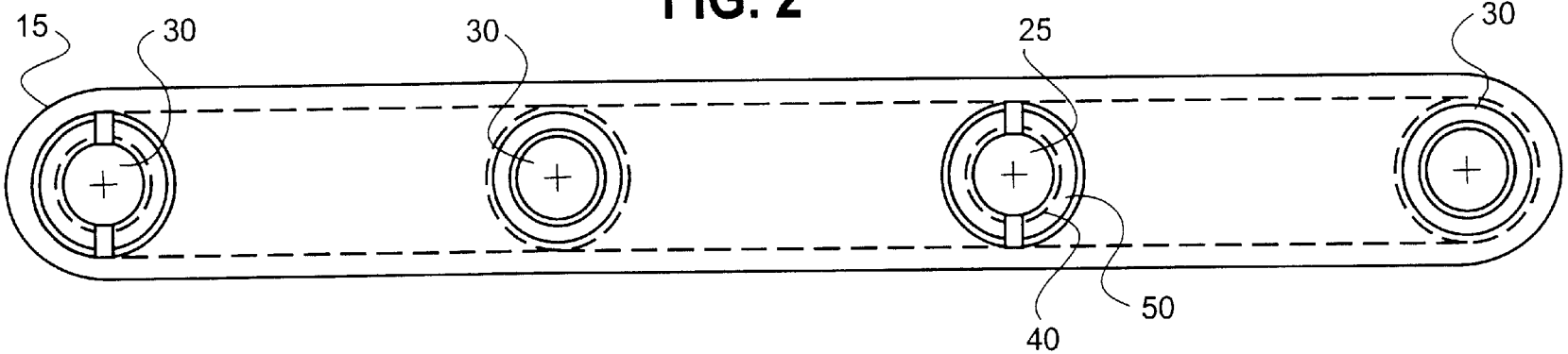
FIG. 2 is a top elevational view of a preferred embodiment of a cross-member.
Figure 3:
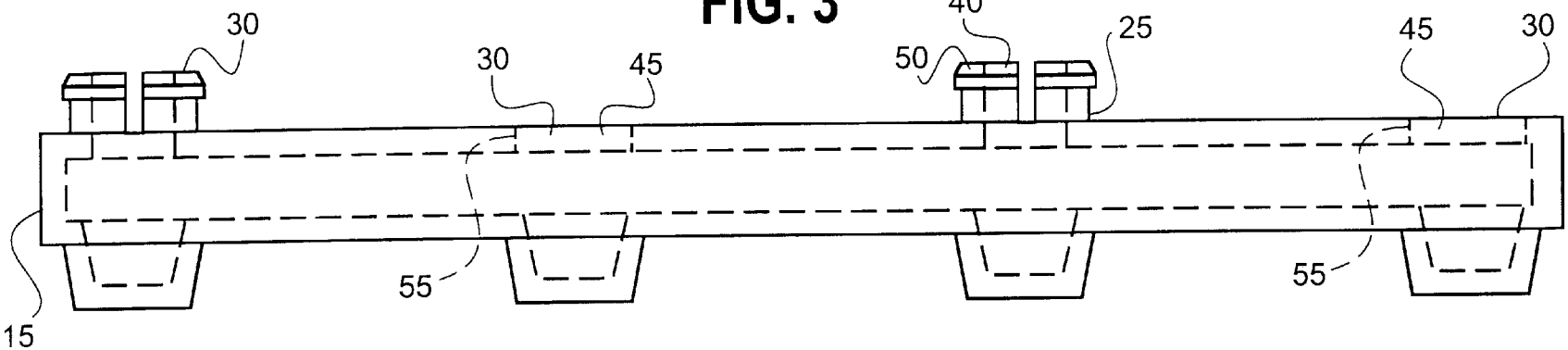
FIG. 3 is a side elevational view of the member of FIG. 2.
Figure 4:
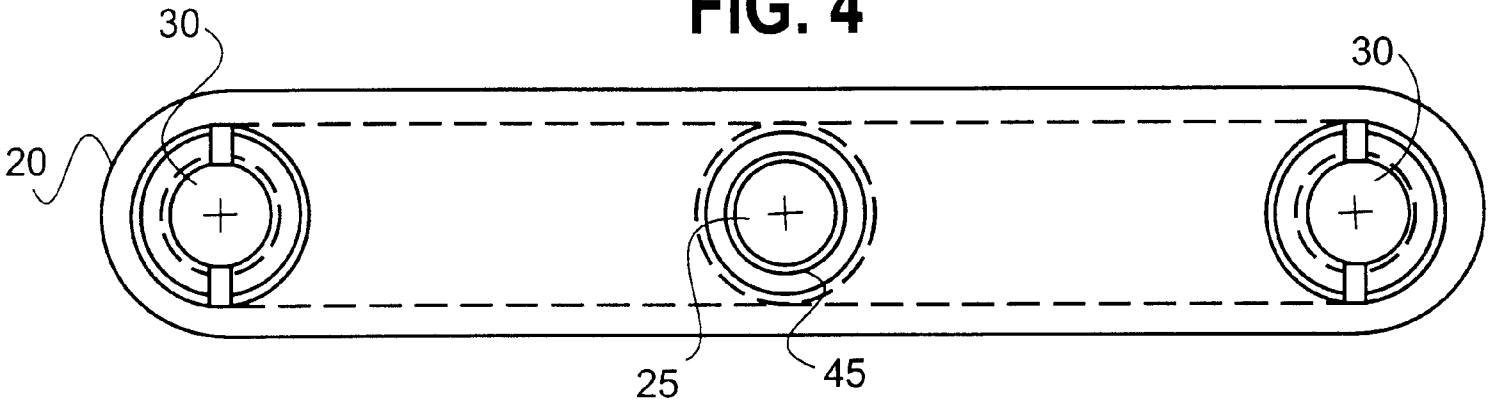
FIG. 4 is a top elevational view of another preferred embodiment of a cross-member.
Figure 5:
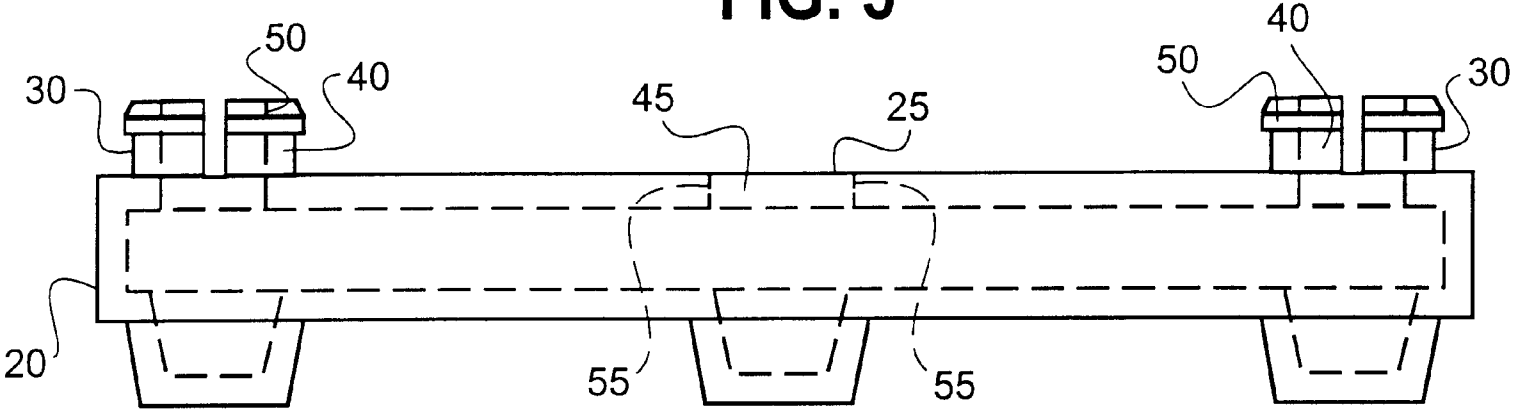
FIG. 5 is a side elevational view of the member of FIG. 4.
Figure 6:
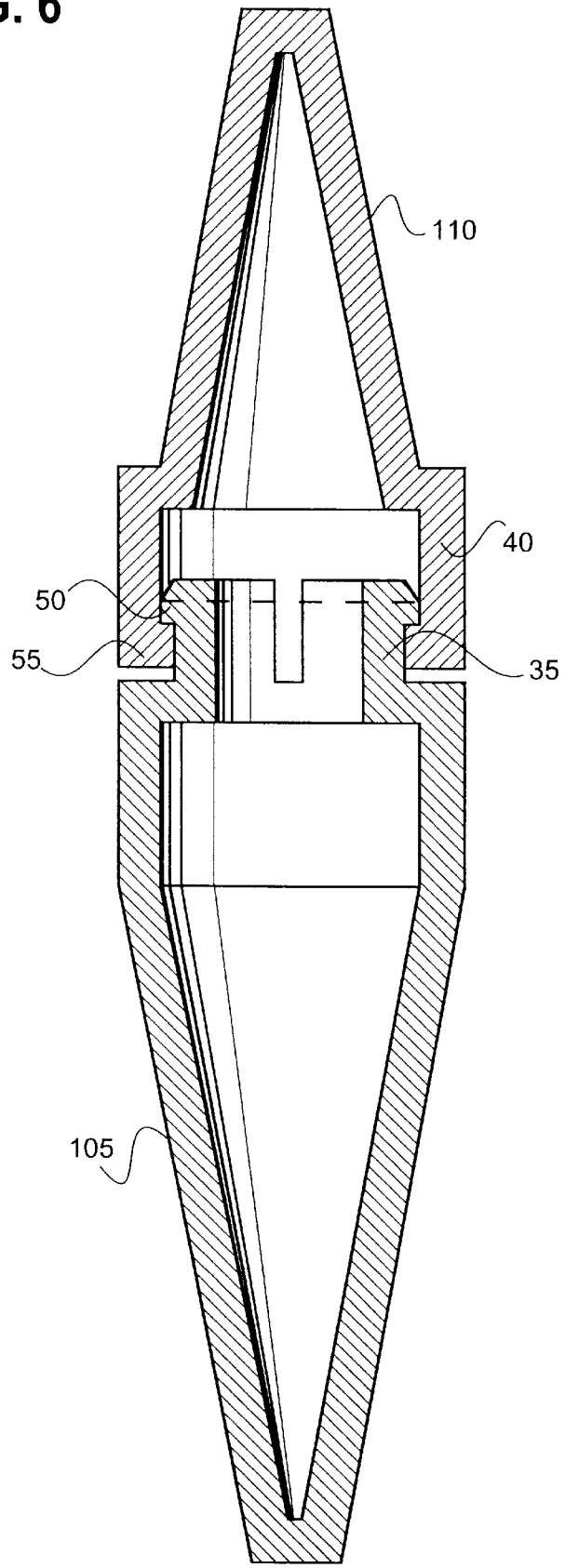
FIG. 6 is a cross-sectional view of the apparatus of FIG. 1 along the line 53 of FIG. 1.

Each member has a pivot site 25 and one or more link sites 30 along its length. As shown in FIGS. 2 and 3, primary member 15 has a pivot site 25 and a plurality of link sites 30. Similarly, as shown in FIGS. 4 and 5, secondary member 20 has pivot site 25 and link sites 30.

Module 10 is constructed by attaching primary member 15 and secondary member 20 at their respective pivot sites 25. In the preferred embodiment, primary member 15 is pivotally connected to secondary member 20 so that the members can rotate about the pivot sites 25. This allows the module 10 to be opened or closed like a pair of scissors to achieve the desired angle 35 between primary member 15 and secondary member 20.

Primary member 15 and secondary member 20 can be connected by any suitable fastening means, including, but not limited to, a nut and bolt, a pin or a rivet. In the preferred embodiment, primary member 15 and secondary member 20 are connected by snap locking a male coupling located at the pivot site of one of the members into a female coupling located at the pivot site of the other member. In the embodiment shown in FIGS. 1–6, male coupling 40 is located on primary member 15 and female coupling 45 is located on secondary member 20. Male coupling 40 features a rim 50 and female coupling 45 features channel 55. When male coupling 40 is snapped into female coupling 45, rim 50 fits snugly against channel 55 so that male coupling 40 is held securely but rotatably within female coupling 45.

Figure 7:
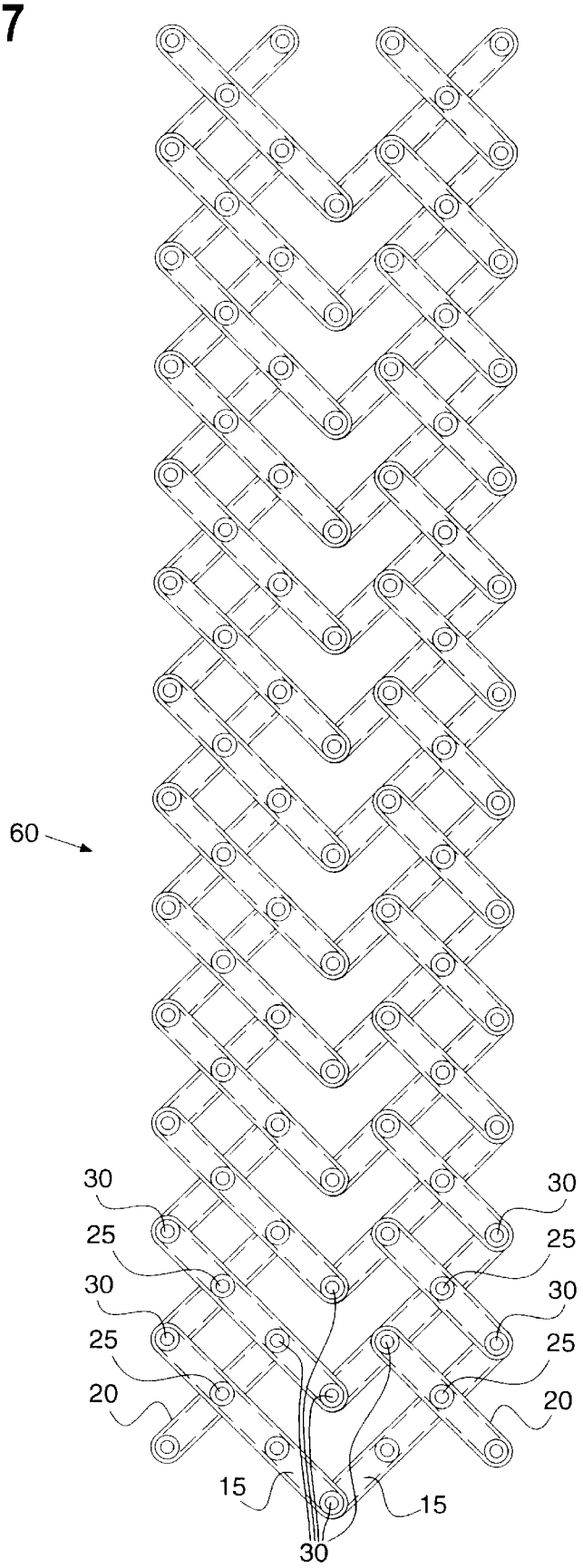
FIG. 7 is a top elevational view of a protective network.

Just as the primary member 15 and secondary member 20 are connected to one another at the pivot sites 25 to form a module 10, one module is connected to one or more other modules at the link sites 30 to form a protective network 60 (see FIG. 7). Modules can be connected at the link sites by any suitable fastening means, including, but not limited to, a nut and bolt, a pin or a rivet. In the preferred embodiment, the modules are connected at the link sites by the same type of coupling system used to link the members at the pivot sites, namely, by male and female snap-fit couplings. Because each of the modules is connected to, as opposed to merely interlocked with, its neighboring modules, the resulting protective network is stable in all three dimensions.

A member can have any number of link sites and those link sites can have male couplings, female couplings or a mixture thereof. For example, in the embodiment shown in FIGS. 4 and 5, secondary member 20 has two link sites 30 and each link site features a male coupling 40. The primary member 15 shown in FIGS. 2 and 3, on the other hand, has three link sites 30, one which features a female coupling 45 and two which feature male couplings 40. The only requirement is that, if the link site on one module is being connected to the link site of another module, the couplings at those link sites must mate or engage with one another.

Figure 8:
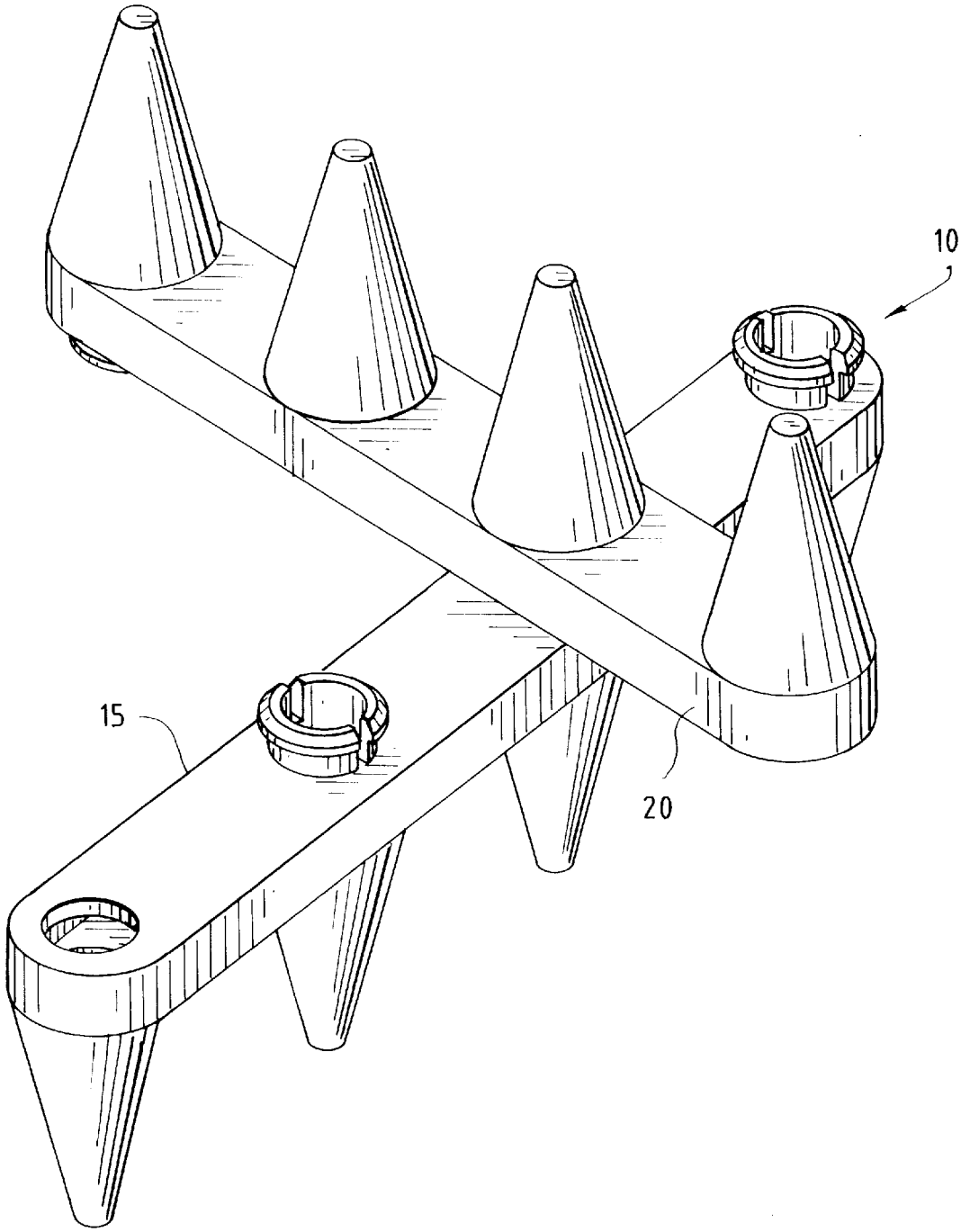
FIG. 8 is a perspective view of another preferred embodiment of the invention.

In any module, primary member 15 and secondary member 20 may be of equal or dissimilar lengths. In the module shown in FIG. 1, primary member 15 is longer than secondary member 20 and has an additional link site 30. In contrast, in FIG. 8, module 10 has a primary member 15 and a secondary member 20 of equal lengths and have the same number of link sites.

The density of the protective network can be altered by connecting the inventive modules in different patterns. The patterns in which the modules can be connected will depend in part on the lengths of, and the number of link sites on, the members used to construct the modules. For example, FIG. 7 illustrates a protective network 60 which can be constructed using modules comprising a longer primary member 15 having three link sites 30 and a shorter secondary member 20 having two link sites 30.

Figure 9:
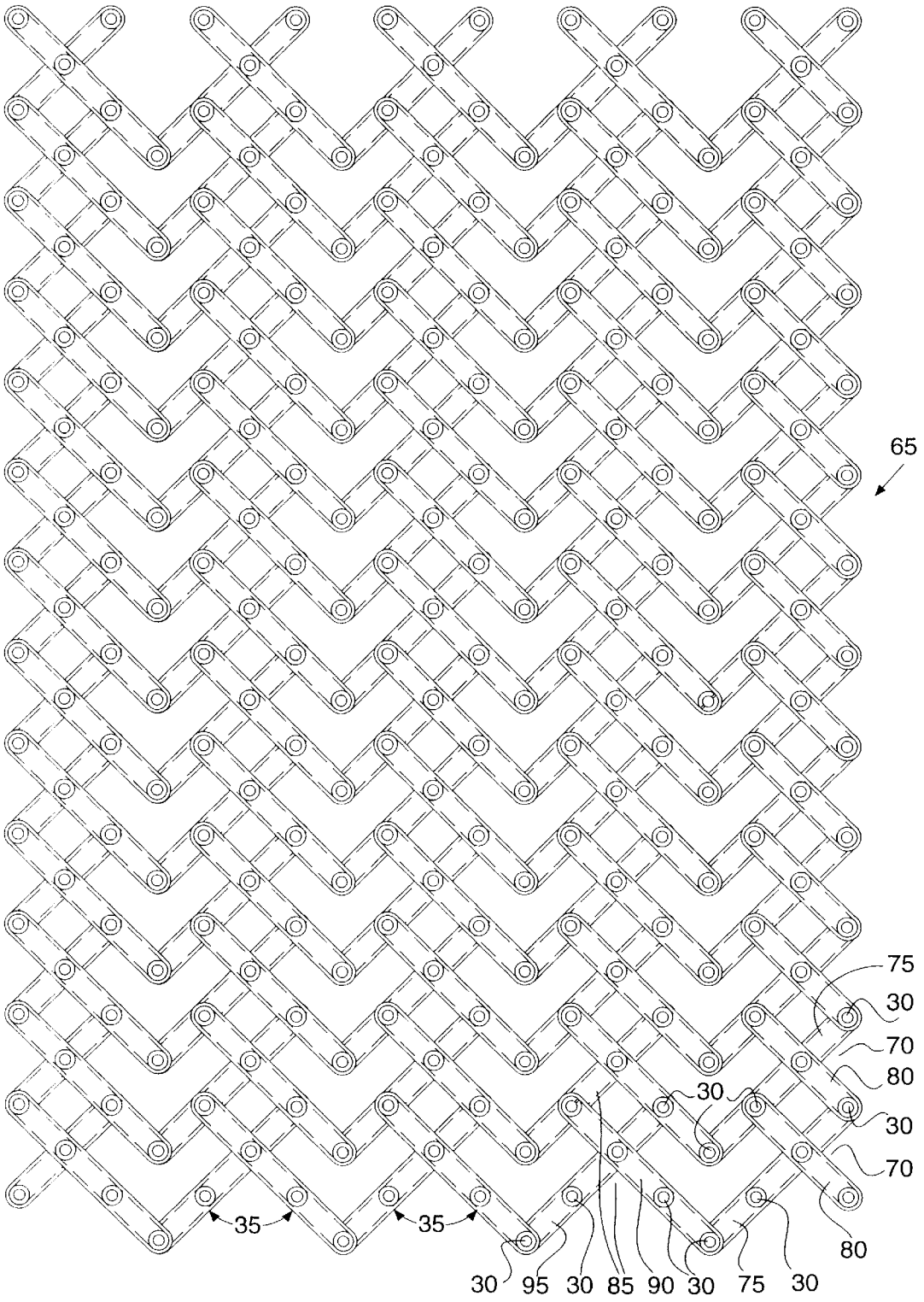
FIG. 9 is a top elevational view of a protective network.

FIG. 9 illustrates a protective network 65 which can be constructed using different sets of modules. Modules 70 have a longer primary member 75 with three link sites 30 and a shorter secondary member 80 with two link sites 30. In contrast, in modules 85, primary members 90 and secondary members 95 are of equal length and have an equal number (three) of link sites.

Figure 13:
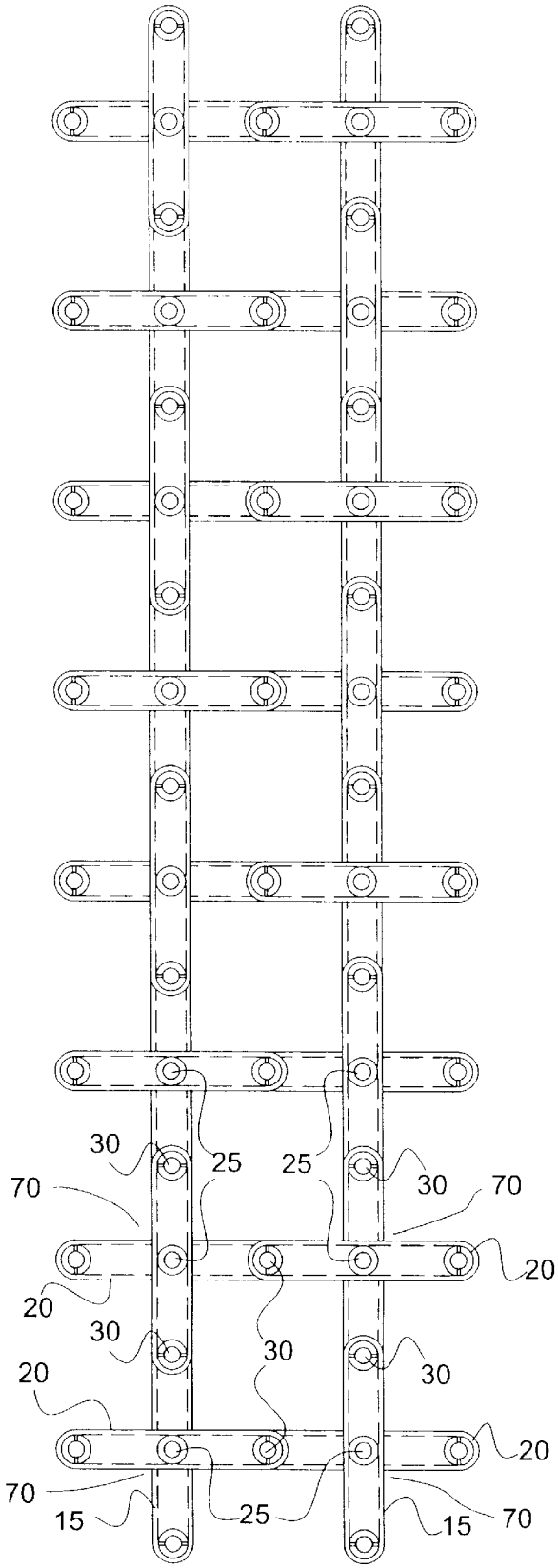
FIG. 13 is a top elevational view of a protective network.
Figure 14:
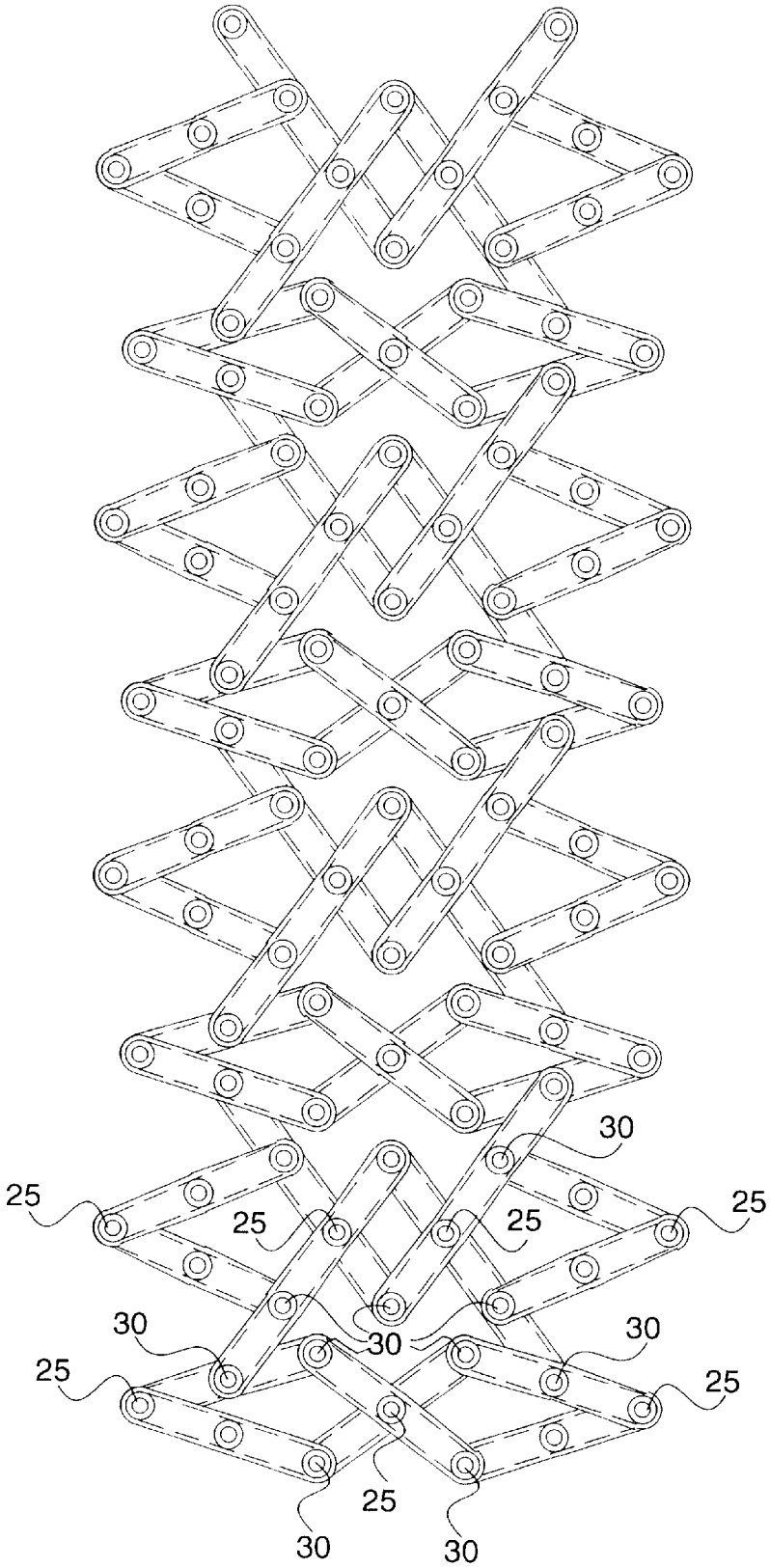
FIG. 14 is a top elevational view of a protective network.

Other possible network patterns are illustrated in FIGS. 13 and 14. The network of FIG. 13 comprises a series of modules 70 comprising members 15 and 20 of equal length, each member having two link sites 30. The simple pattern of FIG. 13 is less dense than that of FIG. 7, for example, making it less expensive to install, but less effective at preventing erosion. The pattern of FIG. 13, therefore, may be more useful where the network is being used to combat relatively weak eroding forces. In contrast, the pattern of FIG. 14, because it is more dense and contains less repetitive shapes, is more expensive to install but is more effective at preventing erosion. It, therefore, may be the better pattern to pick where the network is being used to combat relatively high eroding forces.

Figure 10:
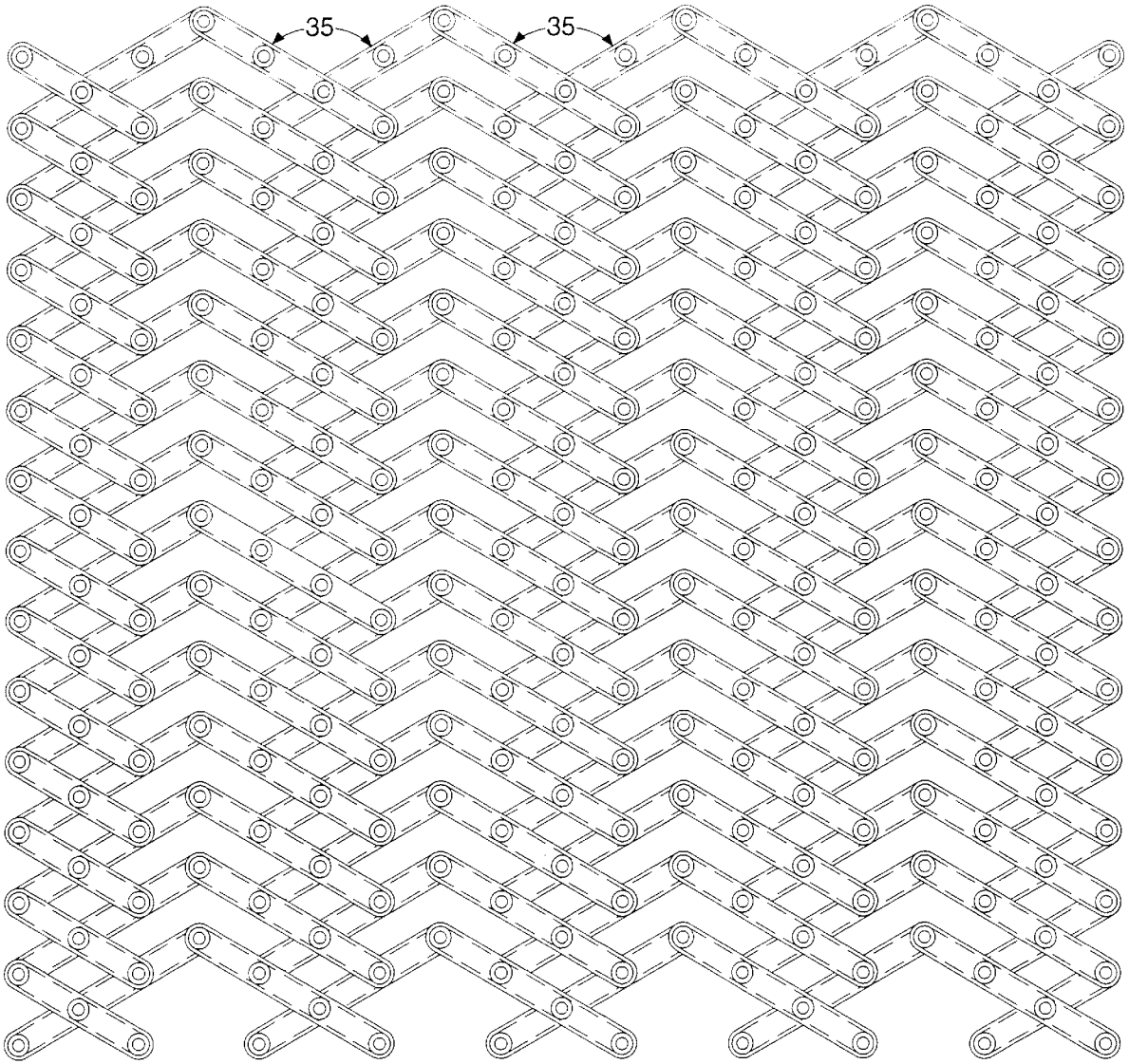
FIG. 10 is a top elevational view of a protective network.

Changing the pattern of the modules is not the only way to modify the density of the protective network. Changing the angle between the primary and secondary members will also change the density of the protective network. For example, the same pattern of modules is illustrated in FIGS. 9 and 10. However, protective network 65 in FIG. 9 is not as dense as protective network 100 in FIG. 10 because the angle 35 between the primary and secondary members is smaller in protective network 65 than it is in protective network 100.

Figure 11:
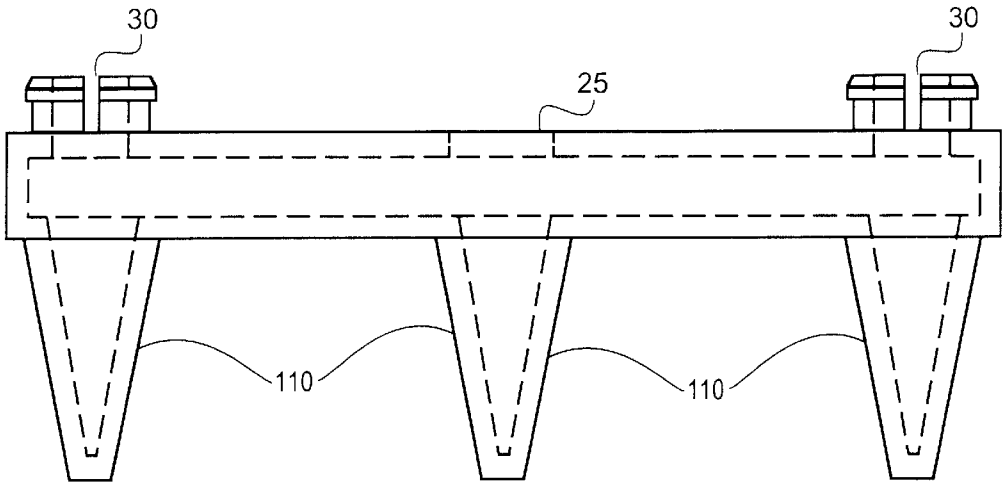
FIG. 11 is a side elevational view of another preferred embodiment of a cross-member.
Figure 12:
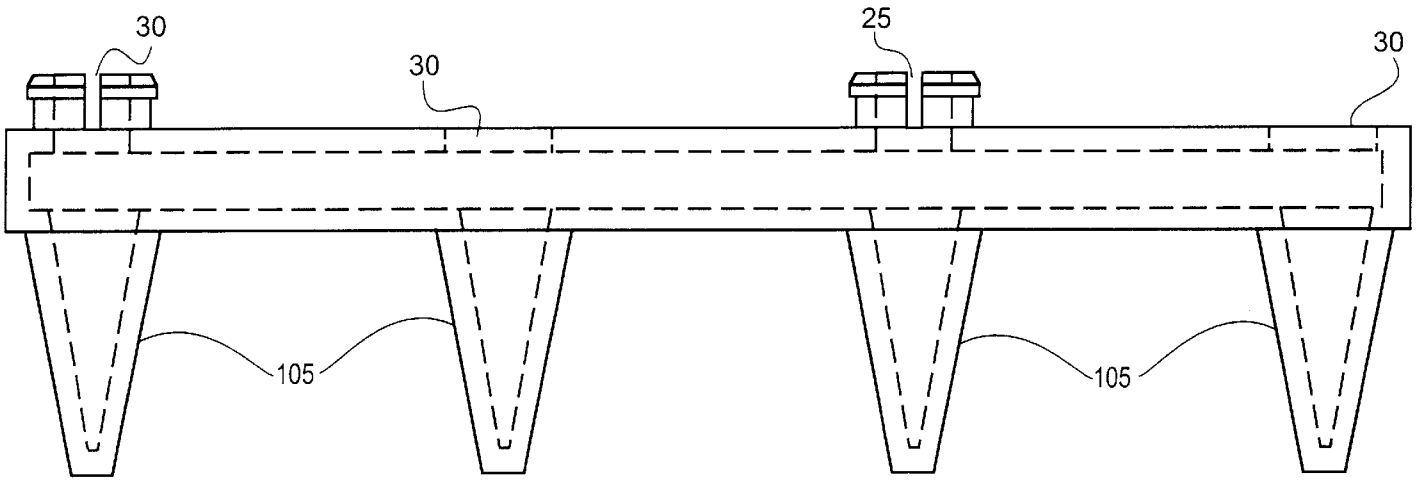
FIG. 12 is a side elevational view of another preferred embodiment of a cross-member.

In a preferred embodiment, a plurality of legs extend from the primary and secondary members and into the protected soil to help anchor both the soil and the protective network. The legs can be shaped or canted to accommodate various environments. In the preferred embodiment illustrated in FIGS. 1, 11 and 12, legs 105 and 110 are located opposite pivot sites 25 and link sites 30. In an installed protective network featuring the module shown in FIG. 1, legs 110 located on secondary member 20 will project down into the soil on which the network is installed, while legs 105 will project up into the soil placed within and over the installed protective network.

While the present invention has been disclosed in terms of the preferred embodiments in order to facilitate better understanding of the invention, it should be appreciated that the invention can be embodied in various ways without departing from its basic principles. Therefore, the invention should be understood to include all possible embodiments and modifications to which do not depart from the invention as set out in the appended claims.

We claim:

1. An apparatus for controlling erosion, comprising:

a first module comprising a primary member and a secondary member, the first module primary member having a pivot site and a link site, and the first module secondary member having a pivot site connectable to the pivot site of the first module primary member; and a second module comprising a primary member and a secondary member, the second module primary member having a pivot site, and the second module secondary member having a pivot site and a link site, the pivot site of the second module primary member being connectable to the pivot site of the second module secondary member;

wherein the link site of the first module primary member is connectable to the link site of the second module secondary member, and further comprising a leg projecting from the first module primary member.

2. The apparatus of claim 1, further comprising a leg projecting from the first module secondary member.

3. The apparatus of claim 2, wherein the leg projecting from the first module primary member and the leg projecting from the first module secondary member project in substantially opposite directions.

4. An apparatus for controlling erosion, comprising:

a first module comprising a primary member and a secondary member, the first module primary member having a pivot site and a link site, and the first module secondary member having a pivot site connectable to the pivot site of the first module primary member; and a second module comprising a primary member and a secondary member, the second module primary member having a pivot site, and the second module secondary member having a pivot site and a link site, the pivot site of the second module primary member being connectable to the pivot site of the second module secondary member;

wherein the link site of the first module primary member is connectable to the link site of the second module secondary member; wherein the pivot site of the first module primary member is pivotally connectable to the pivot site of the first module secondary member; and wherein the pivot site of the first module primary member is pivotally connectable to the pivot site of the first module secondary member by a male coupling located at the pivot site of the first module primary member and a female coupling located at the pivot site of the first module primary member, the male member fitting within the female coupling.

5. An apparatus for controlling erosion, comprising:

a first module comprising a primary member and a secondary member, the first module primary member having a pivot site and a link site, and the first module secondary member having a pivot site connectable to the pivot site of the first module primary member; and a second module comprising a primary member and a secondary member, the second module primary member having a pivot site, and the second module secondary member having a pivot site and a link site, the pivot site of the second module primary member being connectable to the pivot site of the second module secondary member;

wherein the link site of the first module primary member is connectable to the link site of the second module secondary member; wherein the link site of the first module primary member is pivotally connectable to the link site of the second module secondary member; and wherein the link site of the first module primary member is pivotally connectable to the link site of the second module secondary member by a male coupling located at the link site of the first module primary member and a female coupling located at the link site of the second module secondary member, the male member fitting within the female coupling.

6. An apparatus for controlling erosion, comprising:

a first module comprising a primary member and a secondary member, the first module primary member having a pivot site and a link site, and the first module secondary member having a pivot site connectable to the pivot site of the first module primary member; and a second module comprising a primary member and a secondary member, the second module primary member having a pivot site, and the second module secondary member having a pivot site and a link site, the pivot site of the second module primary member being connectable to the pivot site of the second module secondary member;

wherein the link site of the first module primary member is connectable to the link site of the second module secondary member; wherein the first module secondary member has a link site, the second module primary member has a link site, and the link site of the first module secondary member is connectable to the link site of the second module primary member; wherein the link site of the first module secondary member is pivotally connectable to the link site of the second module primary member; and wherein the link site of the first module secondary member is pivotally connectable to the link site of the second module primary member by a male coupling located at the link site of the first module secondary member and a female coupling located at the link site of the second module primary member, the male member fitting within the female coupling.

7. An apparatus for use in erosion control comprising:

a primary member;

a secondary member pivotally connectable to the primary member to form a unit;

means for connecting such unit to another like unit to form a network of such units, wherein the primary member and the secondary member each have a pivot site and the pivot site of the primary member is pivotally connected to the pivot site of the secondary member by a male coupling located at the pivot site of the primary member and a female coupling located at the pivot site of the secondary member, the male coupling fitting within the female coupling.

8. An apparatus for use in erosion control comprising:

a primary member;

a secondary member pivotally connectable to the primary member to form a unit;

means for connecting such unit to another like unit to form a network of such units:

a leg projecting from the primary member; and a leg projecting from the secondary member, wherein the leg projecting from the primary member and the leg projecting from the secondary member project in substantially opposite directions.

* * * * *